US008979640B2

(12) United States Patent
Stewart

(10) Patent No.: US 8,979,640 B2
(45) Date of Patent: Mar. 17, 2015

(54) PLAYER TRACKING METHOD AND A PLAYER TRACKING SYSTEM

(71) Applicant: Aristocrat Technologies Australia Pty Limited, North Ryde (AU)

(72) Inventor: Scott Monroe Stewart, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 13/910,791

(22) Filed: Jun. 5, 2013

(65) Prior Publication Data

US 2013/0344951 A1 Dec. 26, 2013

Related U.S. Application Data

(63) Continuation of application No. 12/428,917, filed on Apr. 23, 2009, now Pat. No. 8,500,550.

(60) Provisional application No. 61/047,574, filed on Apr. 24, 2008.

(51) Int. Cl.
*A63F 9/24* (2006.01)
*G07F 17/32* (2006.01)

(52) U.S. Cl.
CPC ..... *G07F 17/3241* (2013.01); *G07F 17/32* (2013.01); *G07F 17/3239* (2013.01)
USPC ..... 463/25

(58) Field of Classification Search
USPC ..... 463/25
See application file for complete search history.

(56) References Cited

U.S. PATENT DOCUMENTS 4,395,627 A 7/1983 Barker et al.
5,173,597 A 12/1992 Anglin (Continued)

FOREIGN PATENT DOCUMENTS

CA 2548977 10/1999
CA 2538168 3/2005

(Continued)

OTHER PUBLICATIONS

United State Patent and Trademark Office, "Office Action mailed Jan. 5, 2012 for U.S. Appl. No. 12/428,917, filed Apr. 23, 2009", Jan. 5, 2012 , 17 pages.

(Continued)

*Primary Examiner* — Yu-Hsi D Sun
(74) *Attorney, Agent, or Firm* — Hanley, Flight and Zimmerman, LLC

(57) ABSTRACT

A method of player tracking for gaming, the method including: receiving a player identifier at a player identifier input device associated with a gaming terminal; monitoring play of the gaming terminal in response to receipt of the player identifier, the monitoring being performed to determine whether to take any action in respect of a player record of a player tracking module corresponding to the player identifier, the monitoring being carried out such that if the player identifier was received by being read from a player tracking device by the player identifier input device and the player tracking device is removed from a position at which the player tracking device can be read, the monitoring continues after the player tracking device is removed; and stopping monitoring of play of the gaming terminal automatically in response to at least one end condition occurring.

22 Claims, 6 Drawing Sheets

(56) References Cited

U.S. PATENT DOCUMENTS

| | | | | |
|---|---|---|---|---|
| 6,293,866 | B1 | 9/2001 | Walker et al. | |
| 6,302,790 | B1 | 10/2001 | Brossard | |
| 6,997,807 | B2 * | 2/2006 | Weiss | 463/25 |
| 7,033,274 | B1 | 4/2006 | Orus et al. | |
| 2002/0002477 | A1 | 1/2002 | Fox et al. | |
| 2002/0046120 | A1 | 4/2002 | Collins et al. | |
| 2004/0023709 | A1 * | 2/2004 | Beaulieu et al. | 463/16 |
| 2005/0039027 | A1 | 2/2005 | Shapiro | |
| 2005/0047777 | A1 | 3/2005 | Molldrem, Jr. | |
| 2005/0148280 | A1 | 7/2005 | Primos et al. | |
| 2005/0266907 | A1 | 12/2005 | Weston et al. | |
| 2005/0277463 | A1 | 12/2005 | Knust et al. | |
| 2005/0288085 | A1 | 12/2005 | Schubert et al. | |
| 2006/0035707 | A1 | 2/2006 | Nguyen et al. | |
| 2006/0036530 | A1 | 2/2006 | Shkedy | |
| 2006/0177109 | A1 | 8/2006 | Storch | |
| 2006/0205496 | A1 | 9/2006 | Fujimoto | |
| 2006/0211485 | A1 | 9/2006 | Fujimoto | |
| 2006/0267282 | A1 | 11/2006 | Duse | |
| 2007/0026785 | A1 | 2/2007 | Quinney et al. | |
| 2008/0058046 | A1 | 3/2008 | Schwartz et al. | |
| 2008/0064496 | A1 | 3/2008 | Olive | |
| 2008/0113772 | A1 | 5/2008 | Burrill et al. | |
| 2009/0270180 | A1 | 10/2009 | Stewart | |

FOREIGN PATENT DOCUMENTS

| | | |
|---|---|---|
| CA | 2539084 | 9/2006 |
| CA | 2541741 | 10/2006 |
| CA | 2550907 | 12/2006 |
| CA | 2569403 | 6/2007 |
| CA | 2592913 | 12/2007 |
| CN | 1846818 | 10/2006 |
| CN | 1655156 | 8/2007 |
| DE | 20318241 | 3/2004 |
| EP | 1746550 | 1/2007 |
| EP | 1894173 | 3/2008 |
| FR | 2832437 | 5/2003 |
| GB | 2333629 | 7/1999 |
| GB | 2351830 | 1/2001 |
| GB | 2373739 | 10/2002 |
| GB | 2432689 | 5/2007 |
| GB | 2433037 | 6/2007 |
| GB | 2438160 | 11/2007 |
| JP | 2001209727 | 8/2001 |
| JP | 2001212344 | 8/2001 |
| JP | 2002219266 | 8/2002 |
| JP | 2003071082 | 3/2003 |
| JP | 2006296545 | 11/2006 |
| KR | 20030035301 | 5/2003 |
| WO | 03060846 | 7/2003 |
| WO | 2004006196 | 1/2004 |
| WO | 2006026044 | 3/2006 |
| WO | 2007027942 | 3/2007 |

OTHER PUBLICATIONS

United State Patent and Trademark Office, "Office Action mailed Jul. 18, 2012 for U.S. Appl. No. 12/428,917, filed Apr. 23, 2009", Jul. 18, 2012 , 14 pages.

United State Patent and Trademark Office, "Notice of Allowance mailed Mar. 5, 2013 for U.S. Appl. No. 12/428,917, filed Apr. 23, 2009", Mar. 5, 2013 , 18 pages.

* cited by examiner

PLAYER TRACKING METHOD AND A PLAYER TRACKING SYSTEM

CROSS-REFERENCE TO RELATED APPLICATIONS

This application is a continuation of and claims priority to patent application Ser. No. 12/428,917, filed on Apr. 23, 2009, entitled "A PLAYER TRACKING METHOD AND A PLAYER TRACKING SYSTEM", which claims priority to U.S. Provisional Patent Application No. 61/047,574, filed on Apr. 24, 2008, entitled "A METHOD OF GAMING, A GAMING SYSTEM, AND A GAME CONTROLLER", each of which is hereby incorporated by reference in its entirety for all purposes.

FIELD

The present invention relates to a player tracking method and a player tracking system.

BACKGROUND

Many gaming venues employ player tracking (player loyalty) systems. Players participating in the system are provided with a player tracking card, such a smart card which they can insert into a card reader associated with a gaming machine while they play the gaming machine if they wish to accrue reward points which can be redeemed at a later date, for example, for food or beverages. Current player tracking systems require the player to leave their card in the car reader while playing in order to be eligible to accrue points. A problem with this approach is that player's tend to lose cards by leaving them in the card reader. One attempt to address this problem has been to provide lanyards that can be kept around the player's neck while the card is inserted, however the position of the card reader can make this uncomfortable or impractical.

There is a need for an alternative player tracking system and method.

SUMMARY OF THE INVENTION

In a first aspect, the invention provides, a method of player tracking for gaming, the method including:

- receiving a player identifier at a player identifier input device associated with a gaming terminal;
- monitoring play of the gaming terminal in response to receipt of the player identifier, the monitoring being performed to determine whether to take any action in respect of a player record of a player tracking module corresponding to the player identifier, the monitoring being carried out such that if the player identifier was received by being read from a player tracking device by the player identifier input device and the player tracking device is removed from a position at which the player tracking device can be read, the monitoring continues after the player tracking device is removed; and
- stopping monitoring of play of the gaming terminal automatically in response to at least one end condition occurring.

In an embodiment, the end condition includes receiving the same player identifier at a different gaming terminal.

In an embodiment, the end condition includes a time out condition occurring in respect of the gaming terminal.

In an embodiment, the player identifier is always received by being read from a player tracking device.

In an embodiment, the monitoring is performed to determine whether to alter a loyalty points balance stored in the player record.

In a second aspect, the invention provides, a player tracking system including:

- a monitoring module arranged to monitoring play of a gaming terminal in response to receipt of the player identifier, the monitoring being performed to determine whether to take any action in respect of a player record of a player tracking module corresponding to the player identifier,
- the player tracking system arranged such that if the player identifier was received by being read from a player tracking device by a player identifier input device and the player tracking device is removed from a position at which the player tracking device can be read, the monitoring continues after the player tracking device is removed, and
- the monitoring module arranged to monitor for at least one end condition and stop monitoring of play of the gaming terminal automatically in response to the at least one end condition occurring.

In an embodiment, the player tracking system includes:

- a plurality of gaming terminals; and
- a plurality of player identifier input devices associated with respective ones of the gaming terminals and operable to receive the player identifier.

In an embodiment, the monitoring module is arranged to automatically end monitoring of a gaming machine if the same player identifier is received at a different gaming machine.

In an embodiment, the monitoring module is arranged to start monitoring play of the different gaming machine.

In an embodiment, the monitoring module is arranged to automatically end monitoring of a gaming machine if a time out condition occurs in respect of the gaming terminal.

In an embodiment, the player identifier input device includes a card reader of a player marketing module.

In a third aspect, the invention provides computer program code which when executed implements the above method.

In a fourth aspect, the invention provides a computer readable medium including the above program code.

In a fifth aspect, the invention provides a data signal including the above program code.

In a sixth aspect, the invention provides transmitting and receiving the above data signal.

BRIEF DESCRIPTION OF THE DRAWINGS

Illustrative embodiments of the invention are described in relation to the accompanying drawings in which.

Figure 1:
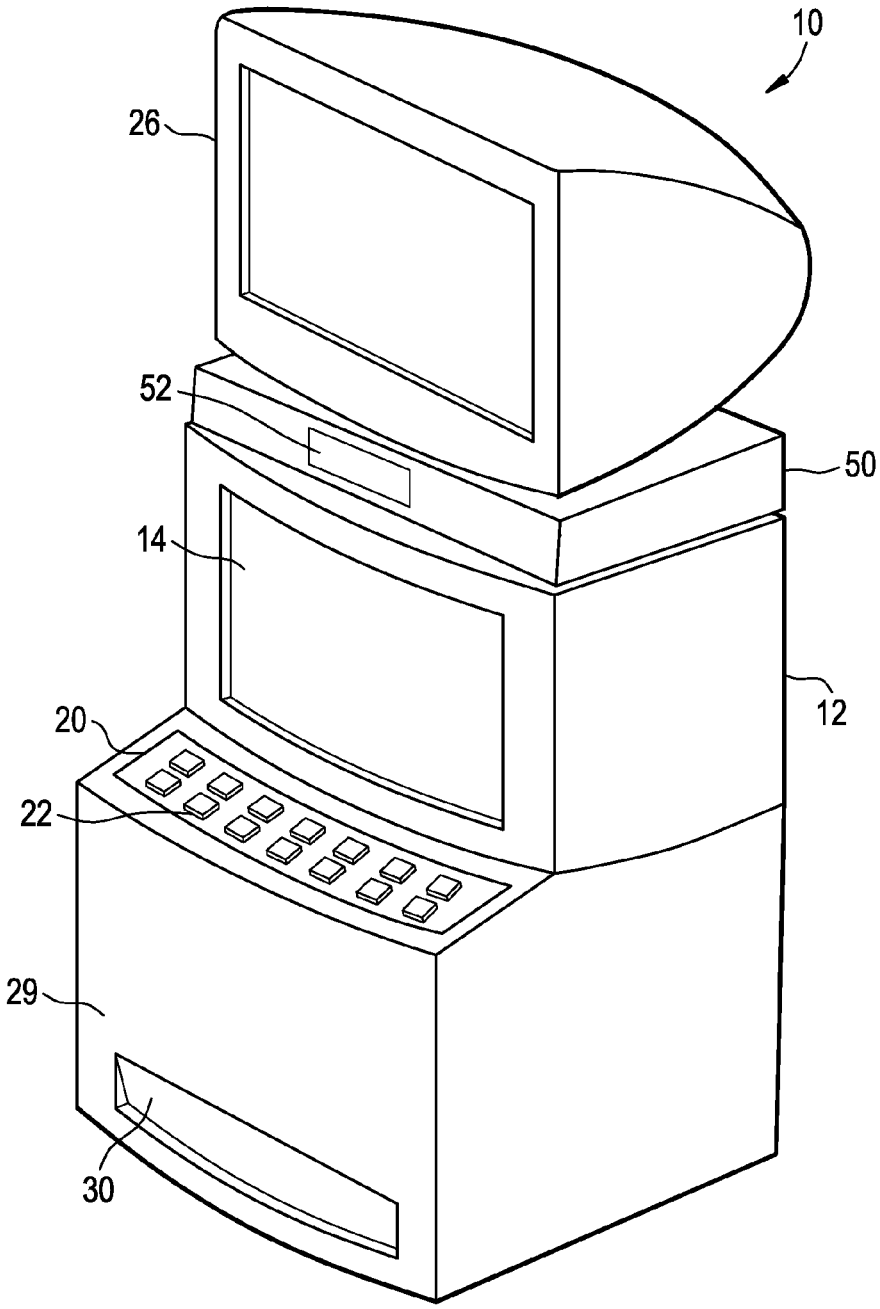
FIG. 1 is a perspective view of a gaming machine of an embodiment.

Features, further aspects, and advantages of the present invention will become apparent from the following description of embodiments thereof, by way of example only, with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings.

DETAILED DESCRIPTION

Referring to the drawings, there is shown a gaming system which includes a player tracking system where player tracking continues after a player tracking device, such as a player tracking card is removed from the player tracking device reader up until an end condition is met.

Persons skilled in the art will appreciate that some venues have electronic gaming tables playable by a plurality of players. For the purpose of this specification, a player position at such a table should be understood as being within the meaning of "a gaming terminal". Accordingly, within this specification "gaming terminal" encompasses a single player, electronic gaming machine arranged to play one or more resident games, a player position at a gaming terminal, and an interactive video gaming terminal in a server based gaming system.

A typical stand alone gaming machine 10 is illustrated in FIG. 1. The gaming machine 10 includes a console 12 having a display 14 on which is displayed representations of a game that can be played by a player. A mid-trim 20 of the gaming machine 10 houses a bank of buttons 22 for enabling a player to interact with the gaming machine, in particular during game play. The mid-trim 20 also houses a credit input mechanism for example a coin input chute and/or a bill collector 24B. Other credit input mechanisms may also be employed, for example, a card reader for reading a smart card, debit card or credit card.

Artwork and/or information, for example pay tables and details of bonus awards and other information or images relating to the game may be provided on a front panel 29 of the console 12. A coin tray 30 is mounted beneath the front panel 29 for dispensing cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. The top box 26 also includes a display which may be of the same type as the display 14, or of a different type.

A player marketing module (PMM) 50 having a display 52 is connected to the gaming machine 10. The main purpose of the PMM 50 is to allow the player to interact with the player loyalty system 540 shown in FIGS. 5 and 6.

Figure 2:
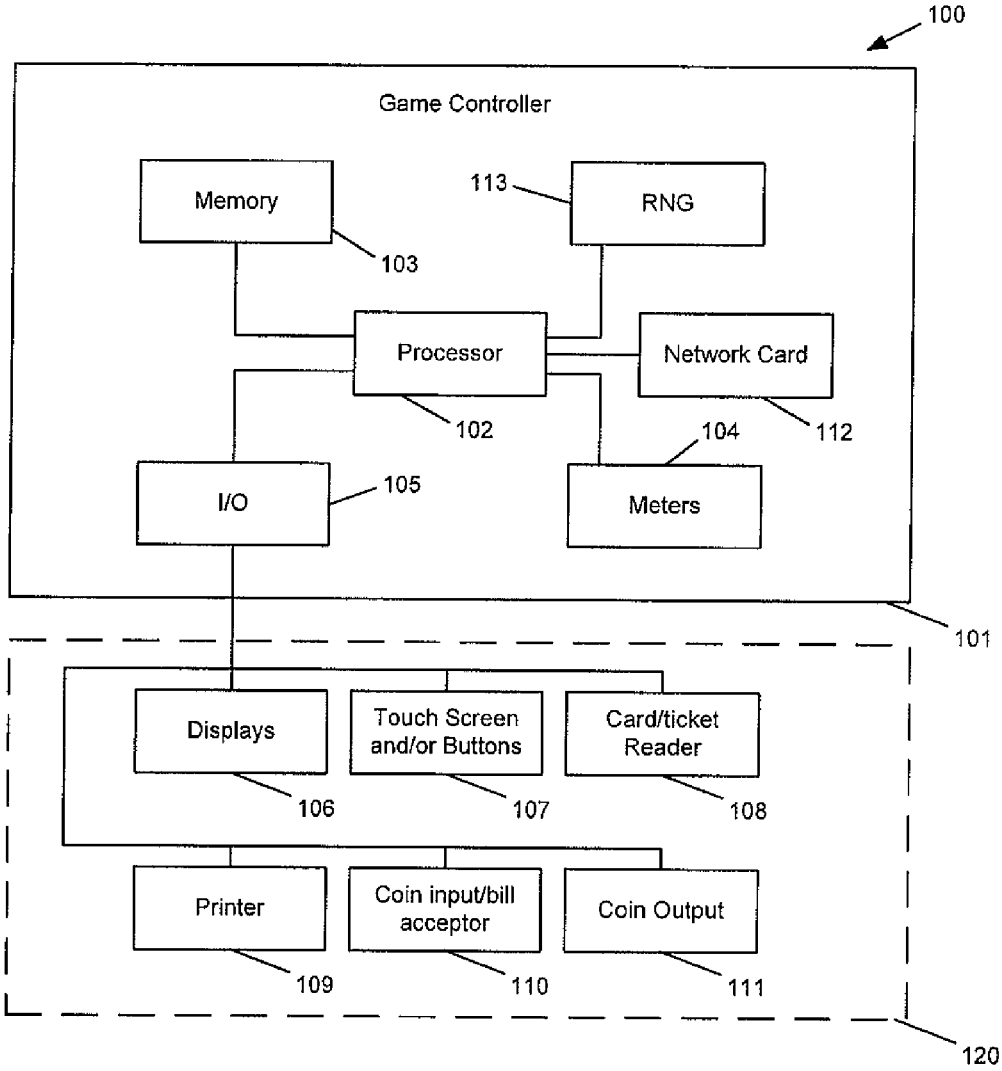
FIG. 2 is a block diagram of a gaming machine of an embodiment.

FIG. 2 shows a block diagram of operative components of a typical gaming machine which may be the same as or different to the gaming machine of FIG. 1.

The gaming machine 100 includes a game controller 101 having a processor 102. Instructions and data to control operation of the processor 102 are stored in a memory 103, which is in data communication with the processor 102. Herein the term "processor" is used to refer generically to any device that can process game play instructions in accordance with game play rules and may include: a microprocessor, microcontroller, programmable logic device or other computational device, a general purpose computer (e.g. a PC) or a server.

Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes computer generated pseudo-random numbers.

In the example shown in FIG. 2, a player interface 120 includes peripheral devices that communicate with the game controller 101 include one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

Figure 3:
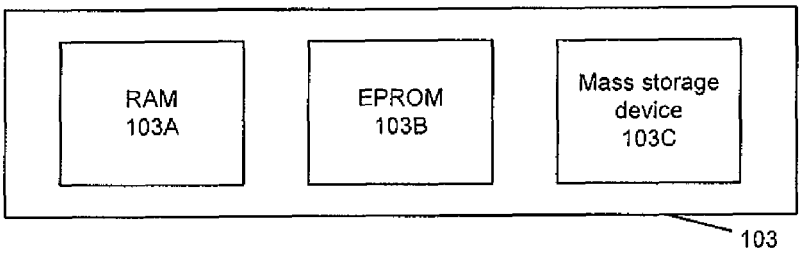
FIG. 3 is a block diagram of the memory of a gaming machine.

FIG. 3 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 4:
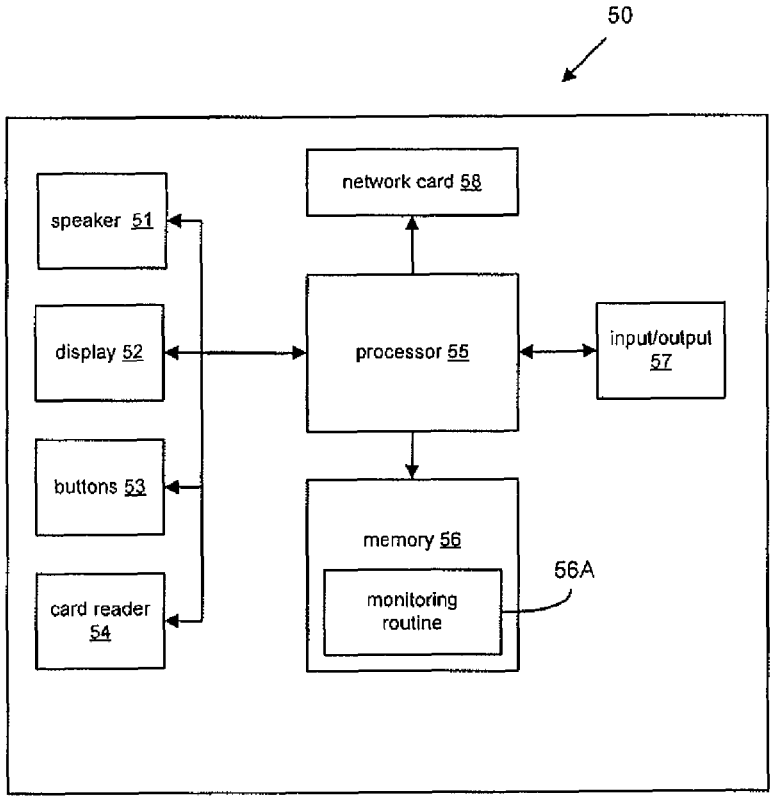
FIG. 4 is a block diagram of a player marketing module of the gaming system of an embodiment.

FIG. 4 is a block diagram of a player marketing module 50. Player marketing modules have other names in the art such as player tracking modules. The player marketing module 50 is connected via input/output port 57 to a serial input output port of the input/output section 105 of the electronic gaming machine. The player marketing module has a player tracking device reader 54 which provides a player identifier input device and a display 52 which may be a touch screen display. In one embodiment, the player tracking device reader is a smart card reader 54 for the purpose of reading a player tracking device in the form of a smart card, for example as part of a loyalty program. However other reading devices may be employed and the player tracking device may be in the form of a magnetic card, proximity card employing radio frequency identification technology, a flash drive or any other portable storage medium capable of being read by a reading device.

The PMM 50 may also have buttons 53 for receiving a player input (at least in embodiments where there is no touch screen display) and a speaker 51. In one alternative embodiment, these buttons are employed to enter a player identifier number.

Input received from the player tracking device reader 54 is processed by processor 55 based on the data stored in memory 56. The PMM 50 is connected to the loyalty system by a network card 58. Thus, in the embodiment, the gaming machine 10 communicates with the central player tracking system 540 via the PMM 50 as described in further detail below.

Processor 55 is arranged to start a monitoring routine 56A stored in memory 56 when it receives a player identifier. It will be appreciated that this monitoring routine and the PMM 50 are part of the player tracking system 540. To this end, the processor 55 is also arranged in data communication with a gaming machine 10 via input output port 57 to obtain data about play of the game on the gaming machine, such as the number of games played, amount wagered, amount won, amount lost etc. Depending on the implementation, the processor either forwards the raw data to the player tracking system 540 in association with the player identifier or processes the raw data and forwards processed data to the player tracking system 540.

As described in further detail below, the player tracking system of the embodiment is arranged to continue to monitor play of the gaming machine until an end condition occurs but in such a manner that monitoring continues without the player tracking device having to be within reading distance of the player tracking device reader.

To this end, in one embodiment, the monitoring routine may involve monitoring for a time out condition to be met at the gaming machine which is being monitored and automatically stoping monitoring if the time out condition is met. In one example, a time out condition may be met if the gaming machine is idle in a defined time period. PMM 50 may be arranged to output a message via display 52 if monitoring is stopped, the message asking for the player's tracking device to be presented to the gaming machine again if they wish to accrue the benefits of player tracking.

Figure 5:
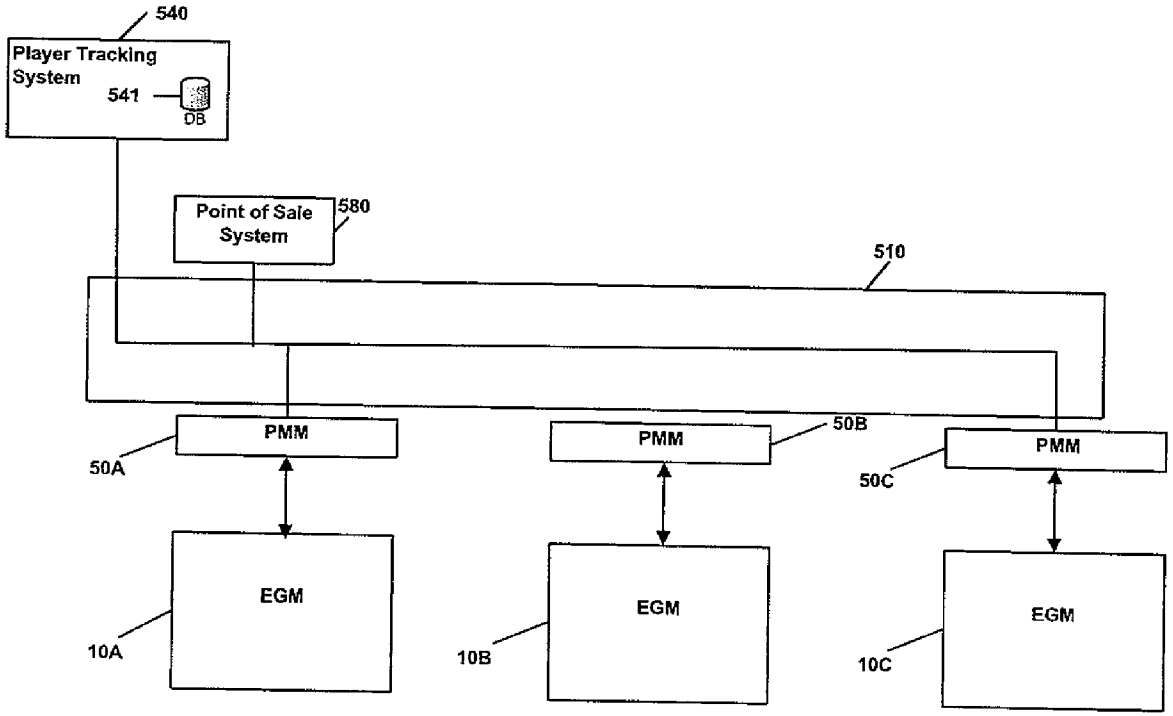
FIG. 5 is a block diagram showing how a plurality of gaming machines are networked and in data communication with a player tracking system.

FIG. 5 shows a series of electronic gaming machines 10 connected via respective player marketing modules 50 over a communications network 510 to a central player tracking system 540 which has a player tracking database 541 storing player records for a plurality of players registered with the tracking system 540. The communications network 510 may be any suitable communications network for example an Ethernet.

Figure 6:
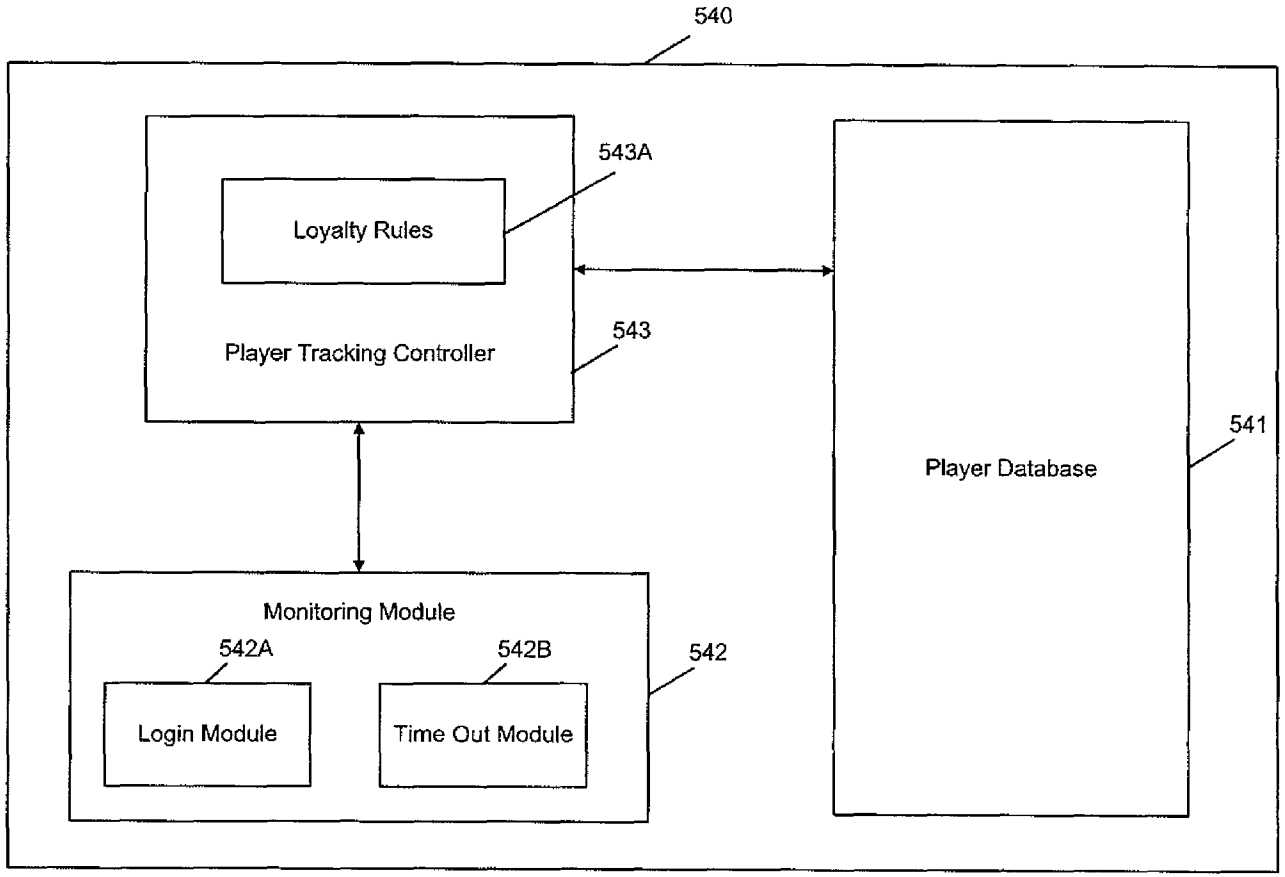
FIG. 6 is a functional block diagram of a player tracking system.

As shown in FIG. 6, the player tracking system 540 has a monitoring module 542. The monitoring module 542 has a login module 542A which tracks which players are currently logged into the system and prevents a player from being logged in via the PMM 50 of more than one gaming machine 10. In one example, this is achieved by refusing to checking the identifications received from PMMs 50 to determine whether data containing the same player identifier is received from two or more PMMs within a defined time period, for example a short period such as 10 seconds. If such data is received, the monitoring module 542 may instruct each PMM 50 to ask the player with a message via display 52 to represent their player tracking device within a defined period such that the PMMs will cease monitoring if the player identifier is not provided. Thus, the monitoring will stop automatically at any machines where the player is not present. In another example, where the same identification is received after a relatively long period (but still within the time out period) the monitoring module may assume that the player has moved machines and instruct the prior gaming machine to cease monitoring while allowing monitoring from the new gaming machine.

FIG. 6 shows that a time out module 542B may be implemented at the player tracking system 540 as an alternative or an addition to the time out function described above as being implemented at the PMM 50.

While monitoring is occurring, player tracking controller 543 takes actions based on loyalty rules 543A and the player record stored in database 541. A typical action is to award loyalty points against the player record identified by the player identifier. Another exemplary action is to make a bonus award to the player.

It will be appreciated that depending on the embodiment, the monitoring module may be provide by the central player tracking system alone, the PMM alone, by a combination thereof, or in some other manner.

Figure 7:
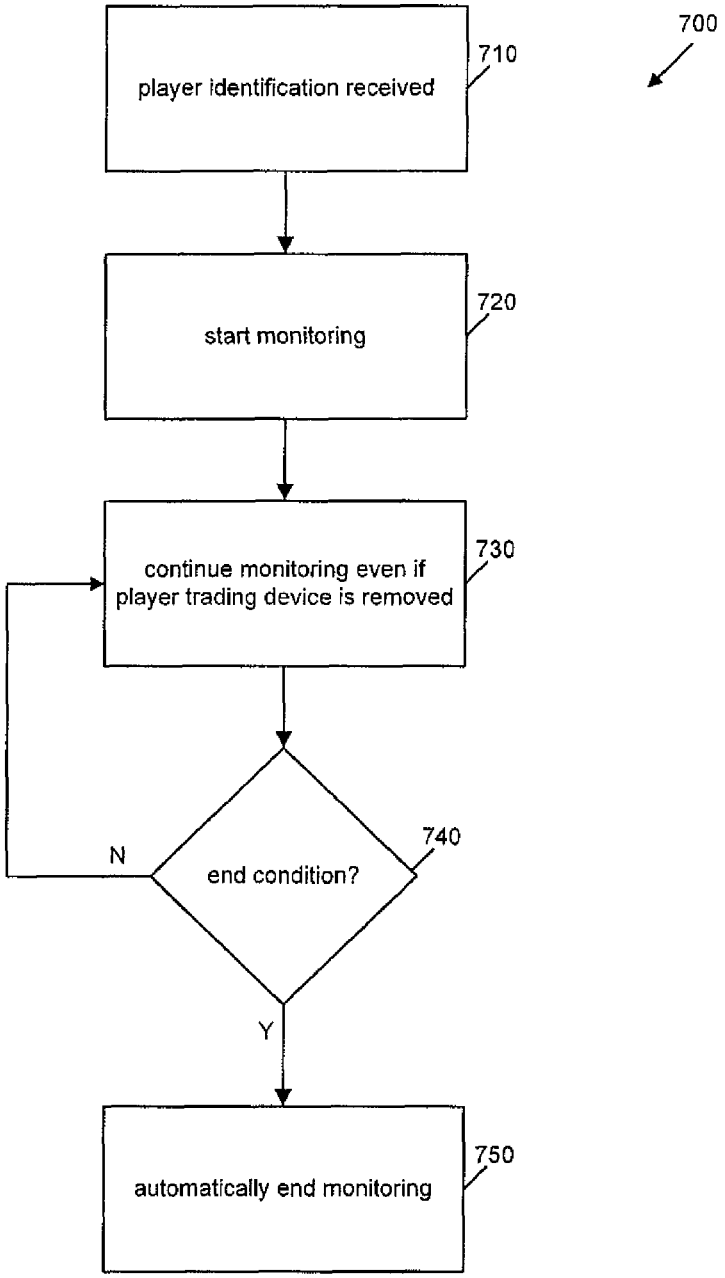
FIG. 7 is a flowchart of a gaming method of an embodiment.

The method 700 of an embodiment is summarised in FIG. 7. A player identifier 710 is received. Monitoring is started 720. Monitoring continues 730 even if the identifier was provided by a player tracking device and the tracking device is removed. It is determined 740 whether an end condition is met. If not, monitoring continues 730. If an end condition is met, monitoring is stopped automatically 750.

Persons skilled in the art will appreciate that other end conditions could be applied. For example, proximity sensors could be deployed to the gaming terminals and employed to determine that the player is still at the gaming machine.

The technique can also account for machine which can be locked by a player, such that they do not terminate an instance of monitoring while a gaming machine is locked.

The above monitoring techniques could be embodied in program code or by hardware modules. The program code could be supplied in a number of ways, for example on a computer readable medium, such as a disc or a memory (for example, that could replace part or all of memory 103) or by receiving a data signal (for example, by transmitting it from a server).

Embodiments of the invention have the advantage that a player tracking device does not have to be kept in a position where it can be read. Such embodiments advantageously make it less likely that players will lose player tracking devices such as cards by leaving them in the PMM. Embodiments of the invention have the advantage that they prevent players from rorting the system.

It will be understood to persons skilled in the art of the invention that many modifications may be made without departing from the spirit and scope of the invention. In particular, that features of embodiments of the invention can be combined to form other embodiments.

It is to be understood that, if any prior art publication is referred to herein, such reference does not constitute an admission that the publication forms a part of the common general knowledge in the art in any country.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method of player tracking for gaming, the method comprising:

receiving a player identifier at a player identifier input device associated with a gaming terminal;

determining whether the same player identifier has already been received within a predefined time period;

outputting a message in response to said determining, wherein the message requests the player identifier to be presented at the player identifier input device again to confirm that the player is present at the gaming terminal;

monitoring play of the gaming terminal in response to receipt of the player identifier, the monitoring being performed to determine whether to take any action in respect of a player record of a player tracking module corresponding to the player identifier, the monitoring being carried out such that if the player identifier was received by being read from a player tracking device by the player identifier input device and the player tracking device is removed from a position at which the player tracking device can be read, the monitoring continues after the player tracking device is removed; and stopping monitoring of play of the gaming terminal automatically in response to at least one end condition occurring.

2. A method of gaming as claimed in claim 1, wherein the end condition comprises receiving the same player identifier at a different gaming terminal.

3. A method of gaming as claimed in claim 1, wherein the end condition comprises a time out condition occurring in respect of the gaming terminal.

4. A method as claimed in claim 1, wherein the player identifier is always received by being read from a player tracking device.

5. A method as claimed in claim 1, wherein the monitoring is performed to determine whether to alter a loyalty points balance stored in the player record.

6. A player tracking system comprising:

a monitoring module arranged to monitoring play of a gaming terminal in response to receipt of the player identifier, the monitoring being performed to determine whether to take any action in respect of a player record of a player tracking module corresponding to the player identifier, the determining including:

determining whether the same player identifier has already been received within a predefined time period, and outputting a message in response to said determining, wherein the message requests the player identifier to be presented at the player identifier input device again to confirm that the player is present at the gaming terminal, the player tracking system arranged such that if the player identifier was received by being read from a player tracking device by a player identifier input device and the player tracking device is removed from a position at which the player tracking device can be read, the monitoring continues after the player tracking device is removed, and the monitoring module arranged to monitor for at least one end condition and stop monitoring of play of the gaming terminal automatically in response to the at least one end condition occurring.

7. A player tracking system as claimed in claim 6, comprising:

a plurality of gaming terminals; and a plurality of player identifier input devices associated with respective ones of the gaming terminals and operable to receive the player identifier.

8. A player tracking system as claimed in claim 6, wherein the monitoring module is arranged to automatically end monitoring of a gaming machine if the same player identifier is received at a different gaming machine.

9. A player tracking system as claimed in claim 8, wherein the monitoring module is arranged to start monitoring play of the different gaming machine.

10. A player tracking system as claimed in claim 6, wherein the monitoring module is arranged to automatically end monitoring of a gaming machine if a time out condition occurs in respect of the gaming terminal.

11. A player tracking system as claimed in claim 6, wherein the player identifier input device comprises a card reader of a player marketing module.

12. A non-transitory computer readable medium comprising computer program code which when executed implements a method of player tracking for gaming, the method comprising:

receiving a player identifier at a player identifier input device associated with a gaming terminal;

determining whether the same player identifier has already been received within a predefined time period;

outputting a message in response to said determining, wherein the message requests the player identifier to be presented at the player identifier input device again to confirm that the player is present at the gaming terminal;

monitoring play of the gaming terminal in response to receipt of the player identifier, the monitoring being performed to determine whether to take any action in respect of a player record of a player tracking module corresponding to the player identifier, the monitoring being carried out such that if the player identifier was received by being read from a player tracking device by the player identifier input device and the player tracking device is removed from a position at which the player tracking device can be read, the monitoring continues after the player tracking device is removed; and stopping monitoring of play of the gaming terminal automatically in response to at least one end condition occurring.

13. A computer readable medium as claimed in claim 12, wherein the end condition comprises receiving the same player identifier at a different gaming terminal.

14. A computer readable medium as claimed in claim 12, wherein the end condition comprises a time out condition occurring in respect of the gaming terminal.

15. A computer readable medium as claimed in claim 12, wherein the player identifier is always received by being read from a player tracking device.

16. A computer readable medium as claimed in claim 12, wherein the monitoring is performed to determine whether to alter a loyalty points balance stored in the player record.

17. A non-transitory computer readable medium comprising computer program code which when executed implements a player tracking system comprising:

a monitoring module arranged to monitoring play of a gaming terminal in response to receipt of the player identifier, the monitoring being performed to determine whether to take any action in respect of a player record of a player tracking module corresponding to the player identifier, the determining including:

determining whether the same player identifier has already been received within a predefined time period, and outputting a message in response to said determining, wherein the message requests the player identifier to be presented at the player identifier input device again to confirm that the player is present at the gaming terminal, the player tracking system arranged such that if the player identifier was received by being read from a player tracking device by a player identifier input device and the player tracking device is removed from a position at which the player tracking device can be read, the monitoring continues after the player tracking device is removed, and the monitoring module arranged to monitor for at least one end condition and stop monitoring of play of the gaming terminal automatically in response to the at least one end condition occurring.

18. A computer readable medium as claimed in claim 17, wherein the computer program code further comprises instructions that execute in conjunction with:

a plurality of gaming terminals; and a plurality of player identifier input devices associated with respective ones of the gaming terminals and operable to receive the player identifier.

19. A computer readable medium as claimed in claim 17, wherein the monitoring module is arranged to automatically end monitoring of a gaming machine if the same player identifier is received at a different gaming machine.

20. A computer readable medium as claimed in claim 19, wherein the monitoring module is arranged to start monitoring play of the different gaming machine.

21. A computer readable medium as claimed in claim 17, wherein the monitoring module is arranged to automatically end monitoring of a gaming machine if a time out condition occurs in respect of the gaming terminal.

22. A computer readable medium as claimed in claim 17, wherein the player identifier input device comprises a card reader of a player marketing module.

* * * * *